US007726515B2

(12) United States Patent
Sherman et al.

(10) Patent No.: US 7,726,515 B2
(45) Date of Patent: Jun. 1, 2010

(54) DECORATIVE AND DISPOSABLE BATH TISSUE DISPENSER

(75) Inventors: Crystal Espinoza Sherman, Menasha, WI (US); Rebecca Catherine Mohr, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 331 days.

(21) Appl. No.: 11/119,385

(22) Filed: Apr. 29, 2005

(65) Prior Publication Data

US 2006/0243739 A1 Nov. 2, 2006

(51) Int. Cl.
*A47F 1/08* (2006.01)

(52) U.S. Cl. ..... 221/309; 221/304; 221/303; 221/307; 221/302

(58) Field of Classification Search ..... 221/1–312 C, 221/309, 302, 304, 307
See application file for complete search history.

(56) References Cited

U.S. PATENT DOCUMENTS

| | | | | |
|---|---|---|---|---|
| 1,708,725 | A | 4/1929 | Huempfner | |
| 2,299,736 | A | 10/1942 | Cavoto | |
| 2,603,427 | A | 7/1952 | Holmes | |
| 2,605,975 | A | 8/1952 | Page et al. | |
| 2,702,672 | A | 2/1955 | Bonsignore | |
| 2,839,255 | A | 6/1958 | Guyer | |
| 2,871,078 | A | 1/1959 | Carleo | |
| 2,876,960 | A | 3/1959 | Glaner | |
| 2,904,274 | A | 9/1959 | Hicks | |
| 2,959,368 | A | 11/1960 | Neff | |
| 2,970,686 | A | 2/1961 | Tolaas | |
| 2,990,090 | A | 6/1961 | Catlett | |
| 3,121,542 | A | 2/1964 | Dyke | |
| 3,130,932 | A | 4/1964 | Pena | |
| 3,245,626 | A | 4/1966 | Casteel | |
| 3,246,937 | A * | 4/1966 | Glabraith | 312/34.22 |
| 3,262,620 | A | 7/1966 | Burt et al. | |
| 3,338,399 | A | 8/1967 | Burt | |
| 3,421,800 | A | 1/1969 | Brown | |
| 3,460,863 | A | 8/1969 | Schaich | |
| 3,529,877 | A * | 9/1970 | Cassidy | 312/34.22 |
| 3,667,597 | A | 6/1972 | Hollister | |
| 3,754,719 | A | 8/1973 | Choy | |
| 3,754,804 | A | 8/1973 | Cushman | |

(Continued)

FOREIGN PATENT DOCUMENTS

| | | |
|---|---|---|
| EP | 0084302 A2 | 7/1983 |

(Continued)

*Primary Examiner*—Gene Crawford
*Assistant Examiner*—Michael K Collins
(74) *Attorney, Agent, or Firm*—Dority & Manning, P.A.

(57) ABSTRACT

An aesthetically pleasing and disposable tissue roll dispenser is disclosed. The tissue roll dispenser may be made from, for instance, a lightweight paperboard and may contain various design elements on the exterior surface. The tissue roll dispenser may contain at least one vertically stacked column of tissue rolls that are gravity fed through the dispenser. For instance, the dispenser may include an opening towards the base of the dispenser for dispensing the tissue rolls. In one embodiment, the opening may be covered by a plastic film that defines a slit. The slit may have a size sufficient to allow the tissue rolls to be dispensed therethrough. The plastic film may be used to protect the tissue rolls from dust, dirt and wetness.

35 Claims, 6 Drawing Sheets

U.S. PATENT DOCUMENTS

| | | | | | |
|---|---|---|---|---|---|
| 3,809,448 | A | * | 5/1974 | Rakaska | 312/34.22 |
| 3,979,019 | A | * | 9/1976 | Bliss | 221/48 |
| 4,058,354 | A | * | 11/1977 | Powaska | 312/45 |
| 4,098,469 | A | * | 7/1978 | McCarthy | 242/560.3 |
| 4,135,678 | A | | 1/1979 | Williams | |
| 4,199,078 | A | * | 4/1980 | Ramirez | 221/309 |
| 4,273,392 | A | * | 6/1981 | Stinson | 312/42 |
| D262,422 | S | * | 12/1981 | Ortiz et al. | D3/273 |
| 4,314,679 | A | * | 2/1982 | Paul et al. | 242/560.3 |
| 4,362,278 | A | | 12/1982 | Hopkinson | |
| 4,410,221 | A | * | 10/1983 | Vallis et al. | 312/34.22 |
| 4,520,968 | A | | 6/1985 | Shpigelman | |
| 4,913,773 | A | | 4/1990 | Knudsen et al. | |
| 5,111,985 | A | | 5/1992 | Lapeyre | |
| 5,294,040 | A | * | 3/1994 | Cohen et al. | 229/116.1 |
| D361,234 | S | * | 8/1995 | Ball | D6/520 |
| 5,570,938 | A | * | 11/1996 | Butler | 312/45 |
| 5,743,397 | A | | 4/1998 | Traver | |
| D394,572 | S | | 5/1998 | Devaney | |
| 5,857,621 | A | | 1/1999 | Poulos | |
| 5,868,335 | A | | 2/1999 | Lebrun | |
| 5,887,298 | A | * | 3/1999 | Semidey | 4/661 |
| 5,971,150 | A | * | 10/1999 | Anderson et al. | 206/389 |
| D419,015 | S | | 1/2000 | Umemoto | |
| 6,012,605 | A | | 1/2000 | Miloscia | |
| 6,116,534 | A | | 9/2000 | Morand | |
| 6,209,786 | B1 | * | 4/2001 | Yelton et al. | 229/241 |
| 6,439,386 | B1 | * | 8/2002 | Sauer et al. | 206/494 |
| 6,645,616 | B1 | | 11/2003 | Sammarco et al. | |
| 6,857,540 | B2 | * | 2/2005 | Mitchell | 221/45 |
| 7,410,052 | B2 | * | 8/2008 | Cook et al. | 206/233 |
| 2002/0063136 | A1 | * | 5/2002 | Sauer et al. | 221/1 |
| 2004/0178210 | A1 | * | 9/2004 | McDonald | 221/63 |
| 2004/0178219 | A1 | * | 9/2004 | Wang et al. | 222/52 |
| 2004/0211693 | A1 | | 10/2004 | Dotson | |
| 2004/0245266 | A1 | | 12/2004 | Mitchell et al. | |
| 2005/0098464 | A1 | | 5/2005 | Tracy | |
| 2005/0178781 | A1 | * | 8/2005 | Welchel et al. | 221/45 |
| 2005/0199690 | A1 | * | 9/2005 | Peterson | 229/122.1 |
| 2006/0027639 | A1 | * | 2/2006 | Rasmussen | 229/122.1 |
| 2006/0168914 | A1 | * | 8/2006 | Steeves-Kiss et al. | 53/443 |
| 2006/0180488 | A1 | * | 8/2006 | Spivey et al. | 206/427 |
| 2006/0201841 | A1 | * | 9/2006 | Mohr et al. | 206/395 |

FOREIGN PATENT DOCUMENTS

| | | | |
|---|---|---|---|
| EP | 0373746 | A1 | 6/1990 |
| EP | 0650451 | B1 | 5/1995 |
| EP | 0922422 | A1 | 6/1999 |
| EP | 1153852 | A2 | 11/2001 |
| EP | 1153852 | A3 | 11/2001 |
| EP | 1405802 | A1 | 4/2004 |
| GB | 2239650 | A | 7/1991 |
| JP | 02228924 | | 9/1990 |
| JP | 2001269285 | | 10/2001 |
| WO | WO9837794 | A1 | 9/1998 |
| WO | WO 0102254 | A2 | 1/2001 |
| WO | WO 0102254 | A3 | 1/2001 |

* cited by examiner

DECORATIVE AND DISPOSABLE BATH TISSUE DISPENSER

BACKGROUND OF THE INVENTION

Disposable sheet style dispensers are well known in the art for dispensing individual folded sheet products such as facial tissues, handsheets, wet wipes, and the like. In general, disposable sheet dispensers typically include a container and a stack or clip of pre-folded, interfolded sheets disposed within the container. The dispensers may be made from various materials. For instance, disposable dispensers are typically made from paperboard, a plastic film or a rigid plastic material. Many containers are decorated with various artwork so that the containers can be openly displayed at home, at the office, in one's car, or at any other desirable location.

Although disposable dispensers are common with respect to stacked facial tissue products, rolled products such as bath tissue rolls, on the other hand, are typically dispensed one at a time from more permanent structures, such as mounted spindles. Spare bath tissue rolls are typically stored out of view, such as being tucked away under counters or in linen closets due to an unaesthetically appealing presentation. When the roll of bath tissue mounted on the spindle runs out, however, consumers are often left stranded without a backup roll readily available.

In view of the above, a need currently exists for a bath tissue roll dispenser. In particular, a need exists for a dispenser for spare rolls of bath tissue that provides easy access to bath tissue rolls in an aesthetically pleasing manner. A need also exists for a bathroom roll dispenser that is completely disposable once all of the bath tissue rolls have been removed from the dispenser. A need also exists for a bath tissue roll dispenser that may have a coordinated appearance with other paper product dispensers.

SUMMARY OF THE INVENTION

The present disclosure is generally directed to a disposable dispenser for rolled products. For instance, in one embodiment, the dispenser can be configured to dispense a plurality of bath tissue rolls. The dispenser can include a container housing made from a disposable material that dispenses rolls of bath tissue in a gravity-assisted manner.

For example, in one embodiment, a bath tissue roll dispenser made in accordance with the present disclosure comprises at least two bath tissue rolls contained in a container housing having a shape configured to hold the at least two bath tissue rolls in a vertical arrangement. For instance, the container housing may be configured to hold from about two to about six bath tissue rolls in a vertical arrangement. The bath tissue rolls may be held in a single stacked column or in a plurality of stacked columns. When containing a plurality of stacked columns, the columns may be in a side-by-side relationship or may be configured one behind the other. In still other embodiments, the tissue roll dispenser may include more than two stacked columns of bath tissue rolls, such as four stacked columns of tissue rolls in a box-shape. When containing more than one stacked column of tissue rolls, the dispenser may hold more than eight rolls, more than ten rolls, more than twelve rolls, and, in one embodiment, more than twenty rolls.

The container housing may include a first end and a second and opposite end. The container housing may define an opening located adjacent the first end for dispensing the bath tissue rolls therethrough. For example, the container housing may include four rectangular shaped side walls that extend in between the first end and the second end. The opening may primarily be located on one of the side walls towards the bottom of the housing. The carton housing can be completely disposable and can be made from a paperboard material. The paperboard material, for instance, may comprise a clay coated paperboard that is less than about 0.75 mm thick. The paperboard may also have a basis weight of less than about 450 gsm.

In order to make the bath tissue roll dispenser aesthetically appealing, the container housing may include at least one design element on an exterior surface. The design element, for instance, may comprise a graphic subject, a graphic style, a pattern, or combinations thereof. The graphic style may comprise, for instance, photograph, pointillism, watercolor, pencil drawings, and the like. In one embodiment, the exterior surface of the tissue roll dispenser may include a plurality of design elements which may comprise any of the design elements described above in conjunction with distinctive and appealing colors. In order to make the dispenser as aesthetically appealing as possible, no more than about one-sixth of the outer surface area of the dispenser may contain printed text, branding and other labeling or regulatory information that does not fit with the intended design elements. In fact, in one embodiment, all of the printed text to be contained on the tissue roll dispenser may be placed on a bottom surface on which the dispenser is to rest.

In one embodiment, the container housing of the bath tissue roll dispenser may include a flap that is defined by a perforation line. The perforation line may be configured to be broken by a user in order to expose the opening for dispensing the bath tissue rolls. For example, the perforation line may completely encircle the flap such that the flap is removable from the container housing to expose the opening. Alternatively, the perforation line may only partically surround the flap. In this embodiment, after the perforation line is broken, the flap remains connected to the container housing along a fold line. The flap may be foldable in an upwards direction or in any suitable direction in order to expose the opening and dispense tissue rolls.

In order to protect the bath tissue rolls while they remain in the container housing, in one embodiment, the opening may be covered by a film. The film may define a slit for allowing the bath tissue rolls to be dispensed therethrough. The film may be adhesively attached to the container housing and may be clear or may be colored. The film not only protects the bath tissue rolls from becoming dirty, but also may serve as a splashguard.

The opening defined in the container housing has a length and width sufficient to allow bath tissue rolls to pass therethrough. As described above, the opening may be located along one of the side walls of the container housing. The opening may also partially extend into a pair of opposing side walls that are adjacent to the side wall on which the opening is primarily located. The opening may also be positioned so as to visibly expose not only the next bath tissue roll to be dispensed but also may partially expose the next adjacent bath tissue roll to allow a user to determine whether only one roll or multiple rolls remain in the container housing. In this manner, a consumer can determine when it is time to purchase further dispensers.

In one embodiment, gravity may be used to assist in dispensing the bath tissue rolls from the dispenser. For instance, the bath tissue rolls may be stacked in a vertical column and the opening may be located adjacent the bottom of the vertical column for dispensing the bottom roll. In order to prevent the bottom roll from falling out of the container housing, the container housing may also include a retaining member that holds the bottom tissue roll in place until accessed by a user.

In still another embodiment, the dispenser housing can include a connecting device for attaching the dispenser housing to an adjacent structure, such as to a spindle. The connecting device, for instance, may comprise a pair of opposing arms that can be folded into position. Each arm, for instance, may comprise a hook-like structure or may comprise a ring-like structure for mounting the roll dispenser onto a spindle.

The present invention is also directed to a coordinated series of disposable paper products that includes a bath tissue dispenser for dispensing rolls of bath tissue. The bath tissue dispenser can be configured to hold a plurality of rolls and can be made from a disposable material such as a paperboard. The bath tissue dispenser may display at least one design element on an exterior surface thereof.

The coordinated series of disposable paper products may include at least one other paper product dispenser in addition to the bath tissue dispenser. The paper product dispenser may be, for instance, a facial tissue dispenser, a paper towel dispenser, a moist wipe dispenser, or a napkin holder. The at least one other paper product dispenser may include at least one design element that coordinates with the design element on the bath tissue dispenser. In this manner, the disposable dispensers can form an aesthetically pleasing coordinated plan throughout a consumer's household.

The design element that may be coordinated between the paper dispensers may comprise a texture, a color, a graphic subject, a graphic pattern, or a graphic style. Graphic styles may include various graphic media and executional methods, including, for instance, watercolor, photograph, pointillism, pencil drawings, highly stylized illustrations, and the like. As used herein, the term "coordinated" means that the design element on the bath tissue roll dispenser has some type of aesthetically pleasing relationship with the design element on the other paper dispensers. Design elements are coordinated, for instance, if they follow the same theme or have a common motif. In one particular embodiment, for instance, the design elements may match. As used herein, "matching" design elements are design elements that go together in appearance but which may vary in size.

In one embodiment, the design element may comprise a color and the color appearing on the bath tissue dispenser may complement a color appearing on one of the other paper dispensers. In order to determine whether one color "complements" with another color, reference may be made to the Munsell color scale, which categorizes and compares colors on the basis of hue, value and chroma. For example, in one embodiment, a non-white color appearing on the bath tissue roll dispenser may be within three steps or increments on the Munsell color scale of a color appearing on the other paper dispenser in terms of any one of hue, value or chroma. For example, the color on the bathroom tissue roll dispenser may be within two steps, such as within one step of the color appearing on the other paper dispenser in terms of any one of hue, value or chroma.

In other embodiments, one or more colors appearing on the bath tissue roll dispenser may be within three steps on the Munsell color scale of one or more colors appearing on the other paper dispenser in terms of any one of hue, value or chroma, but also may be at least one step away on the Munsell color scale in terms of any one of hue, value or chroma. Thus, the colors appearing on the bathroom roll dispenser do not have to exactly match the colors appearing on the other paper dispensers in order for the colors to complement with each other in an aesthetically pleasing manner.

In some embodiments, the paper product that is dispensed from the dispensers may also include a design element that is coordinated with the design elements appearing on the dispensers themselves. For example, the bath tissue rolls may be embossed or printed with a design element that coordinates with a design element on the bathroom roll dispenser and which also coordinates with a design element on other paper dispensers. Design elements may also be incorporated into the bath tissue rolls in other manners. For instance, the design element appearing on the bath tissue roll may be a watermark or may comprise a texture. For example, in one embodiment, texture can be incorporated into the bathroom roll dispenser through a through-air drying process.

Ultimately, the overall design of the design elements on the bath tissue roll dispenser may be coordinated with the overall design of the design elements on at least one other paper dispenser.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1A:
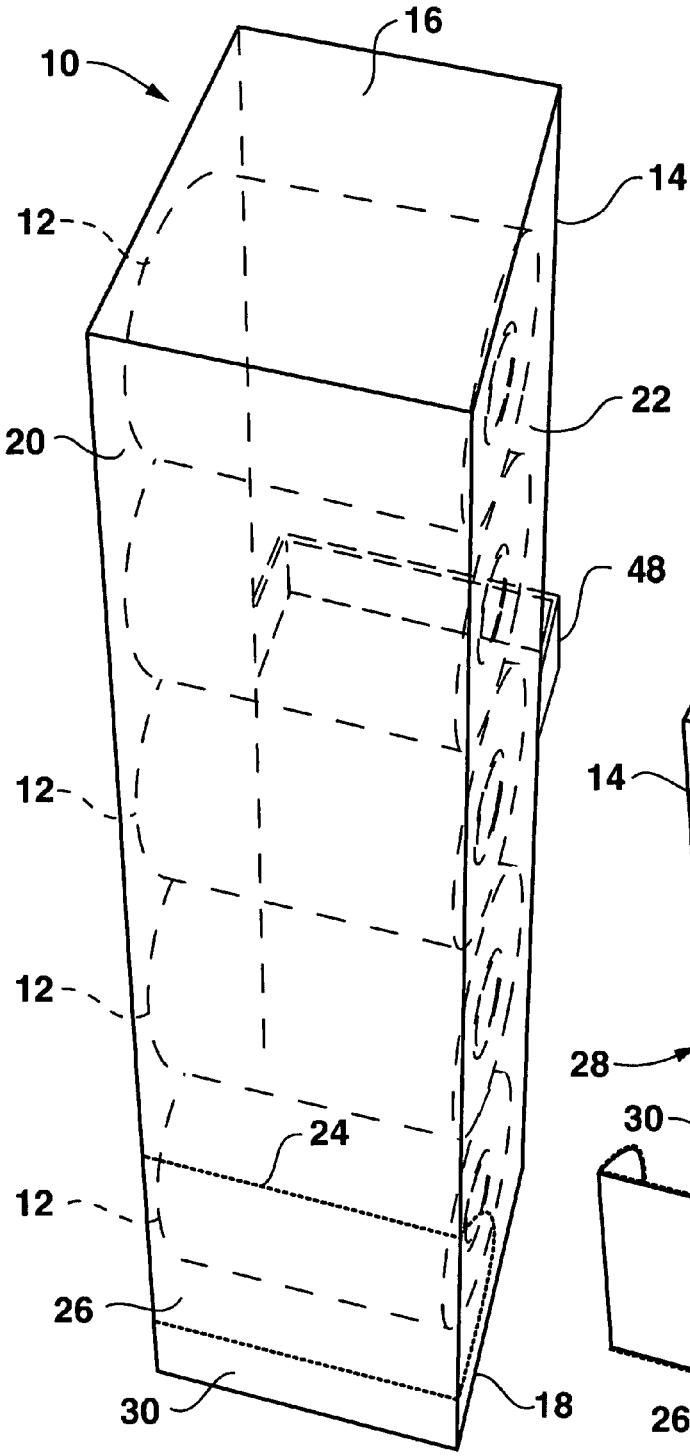
FIG. 1A is a perspective view of one embodiment of a tissue roll dispenser made in accordance with the present invention.

Repeated use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

The present disclosure is generally directed to a disposable dispenser for rolled tissue products, such as rolls of bath tissue, that has an aesthetically pleasing appearance. The dispenser, for instance, can be made from relatively inexpensive materials, such as paperboard which refers to any semi-rigid material that is capable of being folded and contains cellulose fibers. Of particular advantage, the exterior surface of the dispenser may contain an aesthetically pleasing design allowing the dispenser to be placed in full view making the bath tissue rolls easily accessible when a roll in use runs out or is exhausted.

In one embodiment, for instance, the tissue roll dispenser may comprise a gravity-fed carton that includes various design elements on its exterior surface. The dispenser may be configured to stand upright on the floor and, in order to conserve available floor space, may have a relatively small footprint, such as by being one or two rolls wide, although other configurations are possible. In one particular embodiment, the design elements appearing on the roll dispenser may be coordinated with various other disposable paper dispensers. For instance, the design elements appearing on the bath tissue roll dispenser may be coordinated with a facial tissue dispenser, a paper towel dispenser, a moist wipe dispenser, and/or a napkin holder. In fact, in one embodiment, the design elements appearing on the dispenser may also coordinate with one or more design elements appearing on the rolled product itself or upon another paper product contained within the same household.

Referring to FIG. 1A, for instance, one embodiment of a tissue roll dispenser generally 10 made in accordance with the present invention is shown. Although the tissue roll dispensers of the present invention may be used with any suitable rolled product, in the embodiment illustrated in FIG. 1A, the dispenser is configured to hold bath tissue rolls. For example, as shown in FIG. 1A, the dispenser 10, in this embodiment, is configured to hold five bath tissue rolls 12 in a stacked, vertical arrangement. Of course, in other embodiments, the dispenser 10 may be configured to hold less or more than five bath tissue rolls.

The bath tissue roll dispenser 10 comprises a container housing 14 that includes a first end 16 and a second and opposite end 18. At least one side wall extends in between the first end 16 and the second end 18. For instance, in the embodiment shown in FIG. 1A, the container housing 14 includes four rectangular-shaped side walls including a side wall 20 and a side wall 22.

The bottom end 18 of the tissue roll dispenser 10 may serve as a base for placing the dispenser on a flat surface, such as a floor or countertop. Alternatively, as will be described in more detail below, the dispenser 10 may be configured to be mounted onto an adjacent structure.

In order to dispense the bath tissue rolls 12 from the dispenser 10, the container housing 14 includes a perforation line 24 that defines a flap 26. The perforation line 24 is configured to be broken by a user after purchase of the dispenser 10 for removing the flap 26 and exposing an opening 28 as shown in FIG. 1B.

The opening 28 has a size sufficient to allow tissue rolls 12 to be dispensed therethrough. The flap 26 and the opening 28 may be positioned on at least one of the side walls of the dispenser housing 14. In the embodiment shown in FIGS. 1A and 1B, for instance, the flap 26 and the opening 28 extend across the side wall 20 and partially onto the two opposing side walls that are adjacent to the side wall 20. In this manner, the tissue roll 12 can be grasped from the sides and removed from the dispenser 10.

Figure 1B:
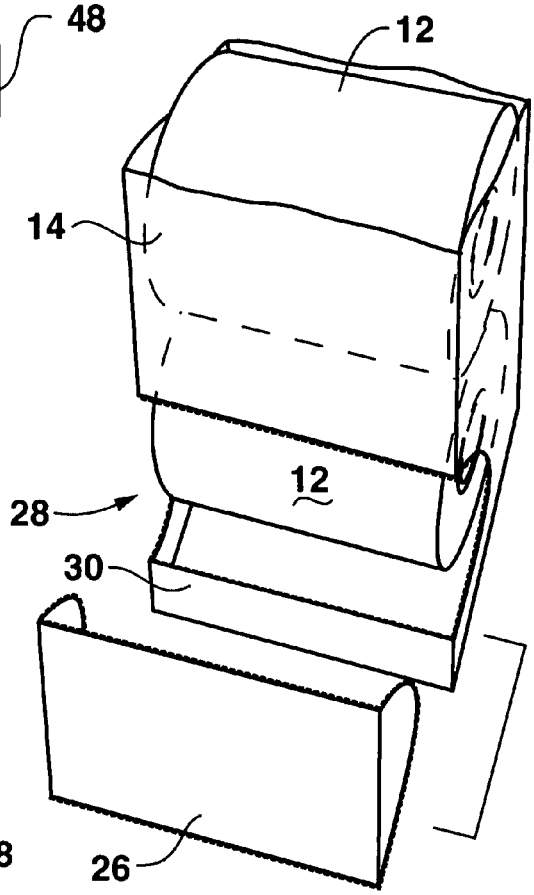
FIG. 1B is a partial perspective view of the dispenser illustrated in FIG. 1A showing removal of a flap for exposing an opening.

As shown in FIGS. 1A and 1B, the opening 28 is generally located adjacent the bottom end 18. In order to prevent the tissue rolls 12 from rolling or falling out of the dispenser 10 at unwanted times, the opening 12 is positioned slightly above the bottom end 18 of the dispenser housing 14 in order to form a retaining member 30. The retaining member 30 forms a lip around the bottom of the dispenser, which prevents the tissue rolls 12 from falling out of the dispenser 10.

In one embodiment, the opening 28 also has a height so that not only is the bottom tissue roll visible through the opening but also a portion of an adjacent roll that is positioned on top of the bottom roll. In this manner, one can determine from a visible inspection as to whether or not only a single roll remains in the dispenser or if a plurality of rolls remain in the dispenser. This information can then be used to determine when it is time to purchase further dispensers.

In one alternative embodiment, a window can be built into the dispenser that extends vertically along one of the side walls. The window can be used to determine exactly how many tissue rolls remain in the dispenser at any given point in time.

The tissue roll dispenser 10 as shown in FIGS. 1A and 1B may be formed from a single blank of material and may be made from any suitable material. In one embodiment, for instance, the dispenser 10 can be made from a disposable material. Once the tissue rolls are exhausted from the dispenser, the dispenser can then be disposed of.

In general, any suitable disposable material may be used to form the tissue roll dispenser. In one particular embodiment, for instance, the container housing 14 is made from a paperboard. The paperboard can have a thickness of less than about 0.75 mm, such as from about 0.3 mm to about 0.6 mm. The paperboard may also have a basis weight of less than about 450 gsm, such as less than about 400 gsm, such as less than about 350 gsm, such as less than about 300 gsm, such as less than about 250 gsm, such as less than about 200 gsm, and, in one embodiment, less than about 100 gsm. The basis weight used for any particular application may depend upon various factors and the desired result. In order to improve the appearance of the paperboard, the paperboard may also be clay coated.

As will be described in more detail below, the paperboard can include various different types of design elements on the exterior surface for providing the tissue roll dispenser with an aesthetically pleasing appearance. In this manner, the tissue rolls may be stored in an easily accessible location as opposed to being hid below countertops and in cabinets.

Figure 2:
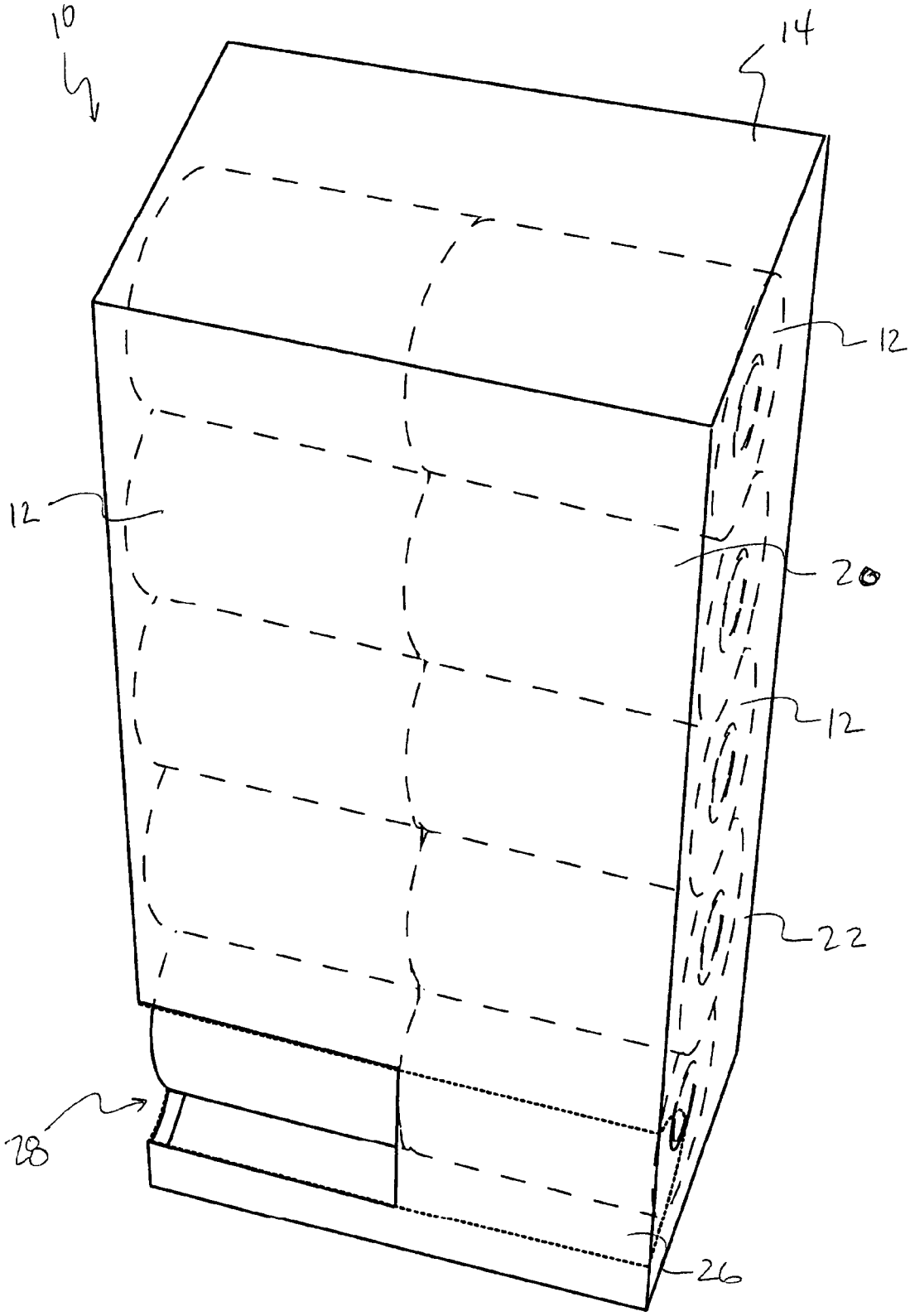
FIG. 2 is a perspective view of another embodiment of a tissue roll dispenser made in accordance with the present invention.

Referring to FIG. 2, another embodiment of a tissue roll dispenser generally 10 made in accordance with the present invention is illustrated. Like reference numerals have been included to identify similar elements. As shown, the dispenser 10 contains a plurality of tissue rolls 12 in a container housing 14. As opposed to the embodiment shown in FIGS. 1A and 1B, instead of a single vertical column of tissue rolls 12, the dispenser 10 as shown in FIG. 2 includes two columns of vertically stacked tissue rolls 12. Thus, the tissue roll dispenser 10 as shown in FIG. 2 has twice the capacity of the dispenser illustrated in FIG. 1A.

In the embodiment shown in FIG. 2, the two columns of tissue rolls are in a side-by-side relationship. It should be understood, however, that the columns may be configured one behind the other. In still other embodiments, the tissue roll dispenser may include more than two columns of vertically stacked tissue rolls, such as three columns or four columns.

As illustrated in FIG. 2, the tissue roll dispenser 10 may include one or two flaps 26 that extend across the side wall 20 of the container housing 14. In the particular embodiment illustrated in FIG. 2, for instance, two flaps 26 are contained on the dispenser 10. In this manner, as shown, a first flap may be removed exposing an opening 28 for dispensing tissue rolls from one side of the dispenser 10. Once the first vertical column of rolls is exhausted, then the second flap 26 may be removed for dispensing tissue rolls 12 from the second vertical stack. If desired, a divider may be placed in the container housing 14 in between the two vertical stacks of tissue rolls.

The divider may serve to support the second vertical stack after the first vertical stack of tissue rolls has been depleted.

Figure 3:
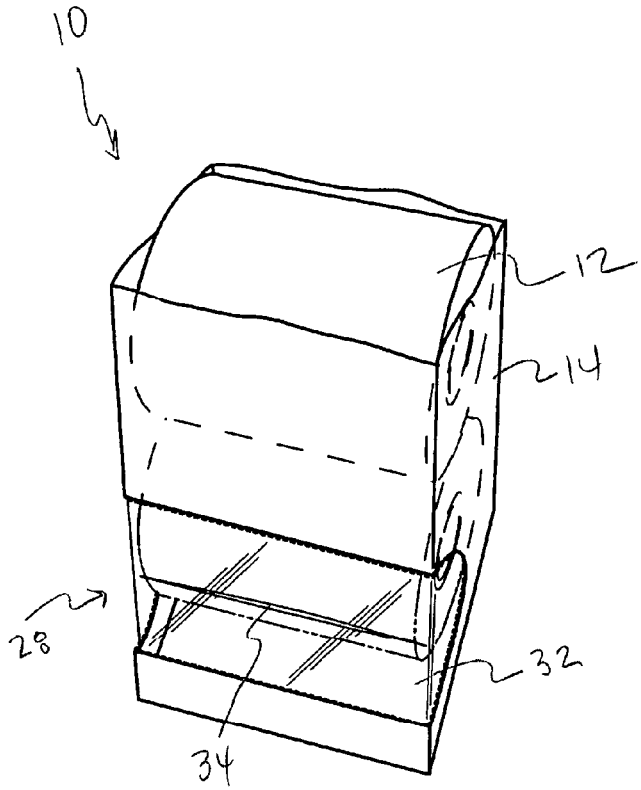
FIG. 3 is a partial perspective view of still another embodiment of a tissue roll dispenser made in accordance with the present invention.

Referring to FIG. 3, still another embodiment of a tissue roll dispenser generally 10 made in accordance with the present invention is illustrated. As shown, the tissue roll dispenser 10 as illustrated in FIG. 3 is very similar to the embodiment shown in FIG. 1A. In the embodiment shown in FIG. 3, however, the tissue roll dispenser 10 further includes a protective film 32 that has been placed over the opening 28. The protective film 32 may be adhered to the internal surface of the container housing 14 or otherwise attached to the container housing in order to cover the opening 28.

The protective film 32 may be included in the tissue roll dispenser 10 in order to prevent the tissue rolls 12 from attracting dirt and dust while they remain within the dispenser. The protective film 32 also serves as a splashguard to prevent the tissue rolls 12 from moisture and wetness.

As shown in FIG. 3, the protective film 32 includes at least one passage such as a slit 34 that allows a user to dispense the tissue rolls 12 from the dispenser 10. In the embodiment illustrated, the slit 34 is generally horizontal. It should be appreciated, however, that the slit may be vertical. In other embodiments, multiple slits may be included that extend in horizontal, vertical and diagonal directions.

In one embodiment, the slit 34 may be perforated prior to use. Thus, when the dispenser 10 is opened by removing the flap 26 to expose the protective film 32, a user can then break the perforation and open the slit 34 for dispensing the tissue rolls.

In general, any suitable film may be used to construct the protective film 32. For instance, the film may be made from a single layer of a polymer or can be constructed of multiple polymer layers. In one embodiment, for instance, the film is made from a film laminate containing, for instance, various thermoplastic polymers including polyvinyl polymers, polyolefins, and/or polyester layers.

The protective film 32 may be transparent, translucent, or opaque. In one embodiment, the film may be clear. Alternatively, the film may have a color that matches a color on the exterior surface of the dispenser 10.

Figure 4:
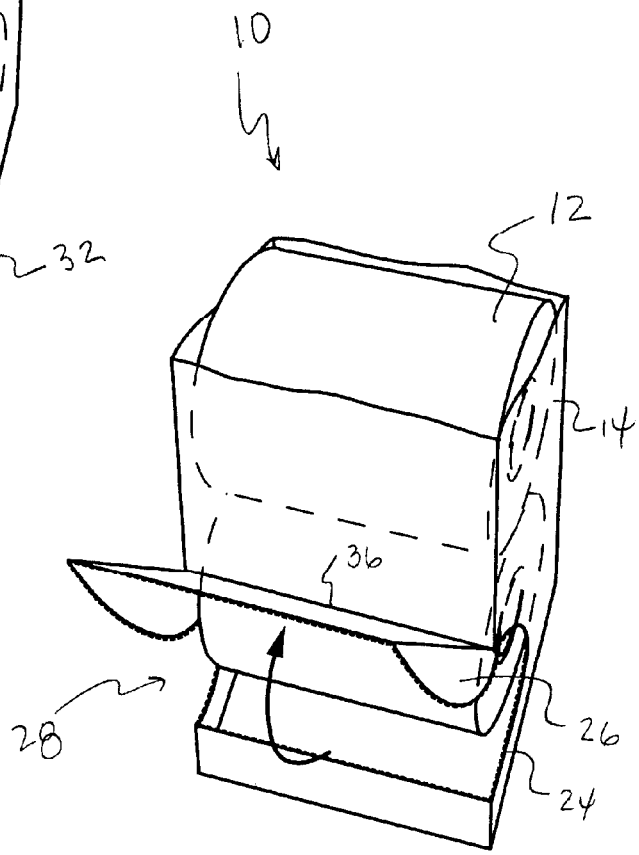
FIG. 4 is a partial perspective view of another embodiment of a tissue roll dispenser made in accordance with the present invention.

Referring to FIG. 4, still another embodiment of a tissue roll dispenser generally 10 made in accordance with the present invention is shown. Again, the tissue roll dispenser 10 as shown in FIG. 4 is very similar to the embodiment shown in FIG. 1A. In the embodiment illustrated in FIG. 4, however, the flap 26 remains connected to the container housing 14. In particular, the perforation line 24 extends around three sides of the flap 26, leaving a fold line 36. Thus, the fold line 36 forms a hinge about which the flap 26 may be pivoted in order to expose the opening 28 and dispense the tissue rolls 12. In the embodiment illustrated in FIG. 4, the flap 26 pivots upwardly to expose the opening 28. It should be understood, however, that the flap may also pivot downwardly or to one side if desired.

In the embodiment illustrated in FIG. 4, the flap 26 may be used alone or in conjunction with the protective film 32 as shown in FIG. 3. When the flap 26 remains attached to the container housing 14, the flap also provides protection to the tissue rolls from dust and moisture.

In the embodiment illustrated in FIG. 4, the flap generally comprises a resilient material that is integral with the container housing 14. It should be understood, however, that in other embodiments the flap may be a separate piece that is attached to the container housing during construction of the housing. In this embodiment, instead of being made from paperboard, the flap 26 may be made from a substantially rigid polymer film. The polymer film may define a window for viewing the contents of the container. When using a separate piece of material, the material may be releasably attached to the container housing in any suitable manner.

Figure 5:
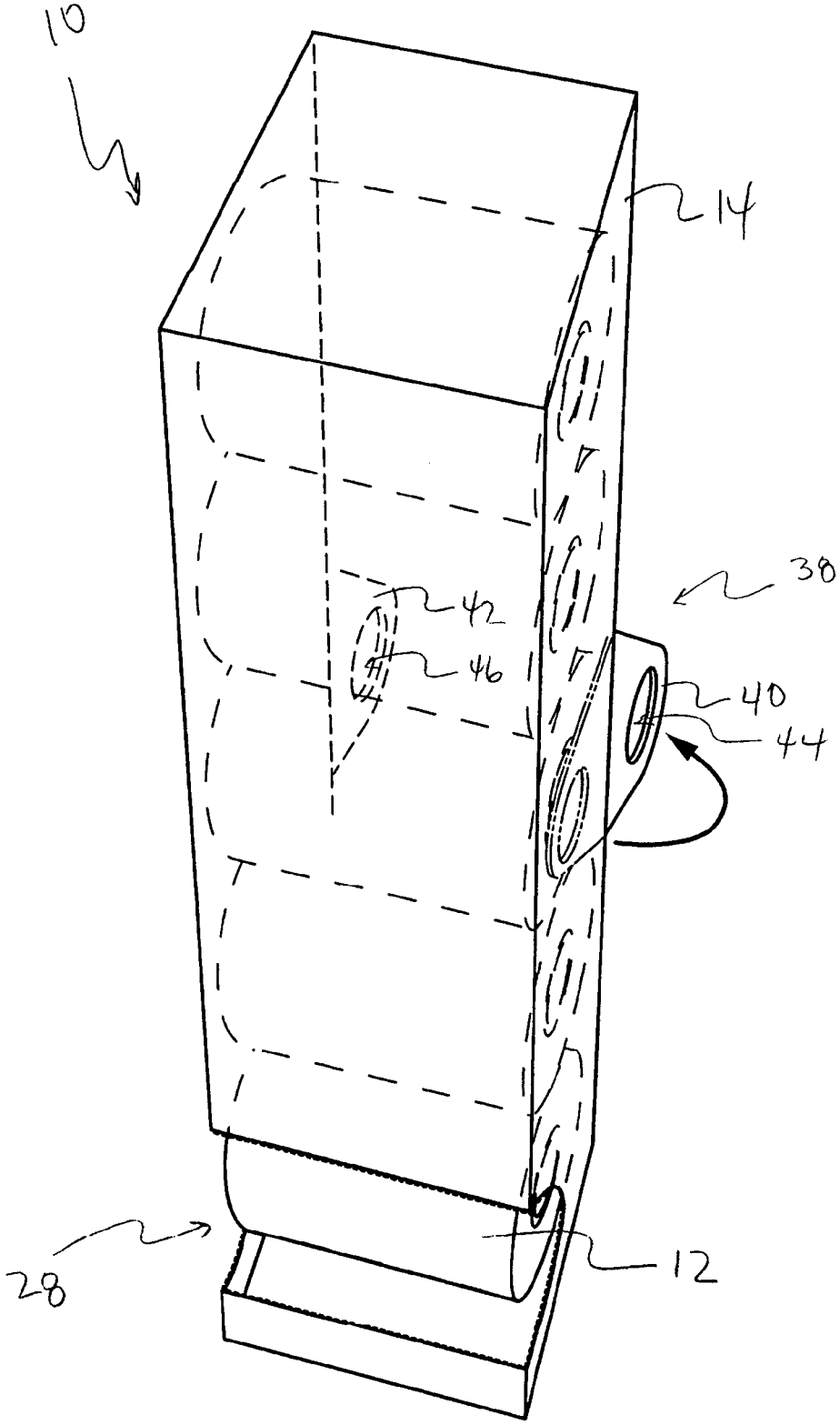
FIG. 5 is a perspective view of still another embodiment of a tissue roll dispenser made in accordance with the present invention.

Referring to FIG. 5, still another embodiment of a tissue roll dispenser generally 10 made in accordance with the present invention is illustrated. The dispenser 10 as shown in FIG. 5 is very similar to the embodiment illustrated in FIG. 1A. In the embodiment shown in FIG. 5, however, the tissue roll dispenser 10 further includes a connecting device generally 38 for connecting the dispenser 10 to an adjacent structure. For example, in this embodiment, the connecting device 38 includes a pair of attachment arms 40 and 42. Each of the attachment arms 40 and 42 define an aperture or opening 44 and 46 respectively. For example, in this embodiment, the attachment arms 40 and 42 are for hanging the tissue roll dispenser 10 on a conventional spindle used to hold tissue rolls, such as bath tissue rolls.

Although apertures 44 and 46 are shown in FIG. 5, it should be understood that the attachment arms 40 may include any suitable attachment device. For example, in other embodiments, the arms 40 and 42 may form hooks that allow the dispenser 10 to be placed on a spindle.

As shown, the attachment arms 40 and 42 are attached to and can be integral with the dispenser housing 14. In particular, the attachment arms 40 and 42 are pivotally connected to the container housing 14. In this manner, the arms can be placed adjacent to the housing when not in use and folded backwards in order to engage a spindle.

In the embodiment illustrated in FIG. 5, the attachment arms 40 and 42 are separate structures that are connected to the container housing. Alternatively, the attachment arms 40 and 42 may form part of the side walls. In this embodiment, for instance, the attachment arms 40 and 42 may be surrounded by a perforation line. When desired to hang the tissue roll dispenser 10 on an adjacent spindle, the perforation line may be broken for bending the attachment arms 40 and 42 towards the rear of the dispenser. If desired, the openings formed in the container housing when the perforation line is broken may be used as a level indicator to determine how many tissue rolls are present in the dispenser. If desired, a core film or protective material may also be attached to the inside of the container in order to protect the contents of the dispenser.

In addition to attachment arms 40 and 42 for mounting the dispenser 10 to a spindle, it should be understood that any suitable connecting device may be attached to the container housing 14. For instance, the connecting device may comprise a tab or flap that is used to attach the dispenser to an adjoining wall.

In addition to having a connecting device, the tissue roll dispenser may also include a handle 48 as shown in FIG. 1A. The handle may be used in order to transport the dispenser when desired. As shown in FIG. 1A, the handle 48 may comprise a separate structure that is connected to the container housing along a back wall. Alternatively, the handle 48 may be integral with the container housing. For example, in one embodiment, one wall of the container housing may include a pair of spaced apart perforated panels. The perforations defining the panels may be broken in order to create two opposing openings that define a handle therebetween.

As described above, one aspect of the present invention involves incorporating design elements on the disposable container housing so that the dispenser has an overall aesthetically pleasing appearance. The design element may be, for instance, a texture, a color, a graphic subject, a pattern, or a graphic style. Graphic styles may include various graphic media and executional methods, including, for instance, watercolor, photograph, pointillism, pencil drawings, highly stylized illustrations, and the like.

Figure 6:
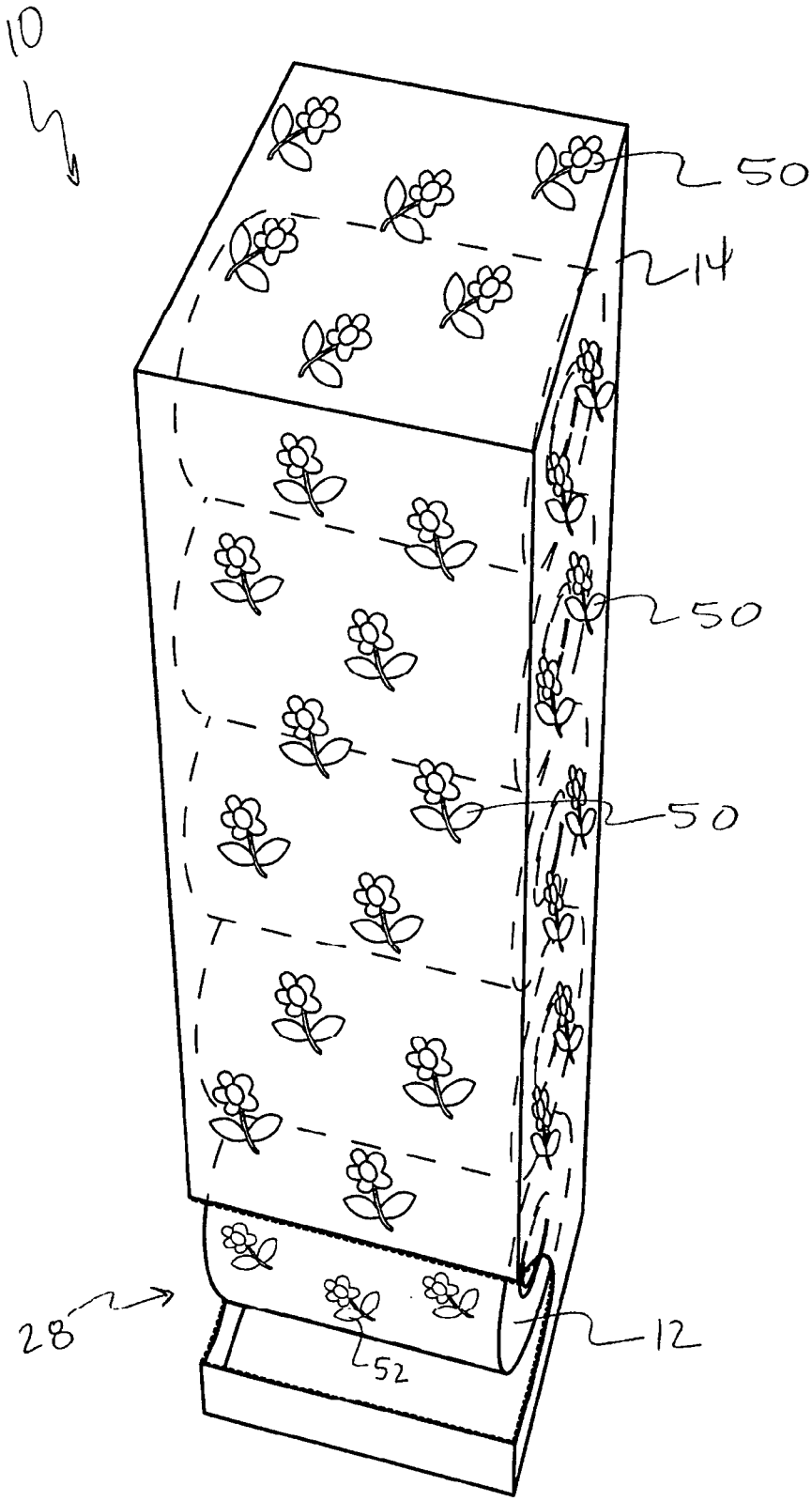
FIG. 6 is a perspective view of the tissue roll dispenser illustrated in FIG. 1A incorporating a design element.

For example, referring to FIG. 6, one embodiment of a tissue roll dispenser generally 10 is shown containing a design element. In particular, the exterior surface of the container housing 14 includes various graphic subjects, namely flowering plants 50. In this embodiment, the tissue roll 12 also includes a flowering plant 52 that coordinates with the flowering plants on the dispenser. The flowering plant 52 on the tissue roll 12, for instance, may be printed on the tissue roll or may be embossed into the tissue roll. In addition to printing or embossing, the design element on the tissue roll may comprise a watermark or may be molded into the tissue using, for instance, a through-air dryer.

In addition to graphic subjects, a color appearing on the tissue roll dispenser 10 may also be complemented with a color appearing on the tissue roll 12. In still other embodiments, a texture appearing on the roll of material 12 may be coordinated with a texture appearing on the dispenser 10.

In one embodiment, the present invention is directed to a coordinated series of disposable paper products. For example, design elements appearing on the tissue roll dispenser 10 may be coordinated with various design elements on other tissue or paper product dispensers. For example, referring to FIG. 7, one embodiment of a coordinated series of disposable paper products is shown. In particular, in this embodiment, the series includes a bath tissue roll dispenser 10, a facial tissue dispenser 100, a dinner napkin holder and dispenser 200, a paper towel dispenser 300 for dispensing a roll of paper towels, and a moist wipe dispenser 400 for dispensing single moist wipe sheets. The moist wipes dispensed from the dispenser 400 may be used, for instance, for household cleaning, as an antibacterial wipe, or may be water dispersible and used as bathroom tissue. As shown, the bath tissue roll dispenser 10 includes graphic symbols 60 comprising a flowering plant and butterflies. The design elements 62 appearing on the facial tissue dispenser 100, on the other hand, comprises a similar flowering plant in combination with a honey bee. On the napkin holder 200, a design element appears comprising the flowering plant in combination with other greenery 64. On the paper towel dispenser 300, a design element 66 comprising a flowering plant and a hummingbird is shown not only on the dispenser 300, but also on the roll of paper towels 302. On the moist wipe dispenser 400, a design element comprising a flowering plant 68 contained within a pot is shown. Although all of the design elements appearing on the multiple products are different, they are all coordinated providing an overall harmonious appearance.

In addition to coordinating graphic subjects, it should be understood that various other design elements may be coordinated with respect to the different paper dispensers. For instance, the colors appearing on all of the dispensers may also be complemented with each other. For example, in one particular embodiment, complementary colors may be selected using the Munsell Color-Order System. The Munsell Color-Order System is a way of precisely complementing colors quantitatively by examining three qualities or attributes of color, namely hue, value and chroma. The Munsell Color-Order System is referenced and used, for instance, in the *Munsell Book of Color, Matte Collection; Munsell Book of Color, Nearly Neutrals Collection*; and *Munsell Book of Color, Glossy Collection*, which are published by the Munsell Color Corporation and are commercially available through GretagMacBeth and the Munsell Laboratory, and which are all incorporated herein by reference.

In the Munsell Color-Order System, hue, value and chroma may be varied independently so that all colors may be arranged according to the above three categories or attributes in a 3-dimensional relationship. This 3-dimensional relationship is referred to as the "Munsell Color Space". The neutral colors are placed along a vertical line called the "neutral axis" with white at the top of the axis, black at the bottom of the axis, and gray shades in between.

The different hues are displayed at various angles around the neutral axis. The chroma scale is perpendicular to the neutral axis and increases outwardly.

Hue is an attribute of color by which colors are distinguished from one another. The hues are arranged from red to yellow to green to blue and to purple. Under the Munsell Color-Order System, a hue color circle is divided into 100 steps or increments of equal visual change. There are 10 major hues broken down into 5 principle and 5 intermediate hues. All of the hues are given a one or two letter designation and are arranged around the color circle. The main hues are red, yellow, green, blue and purple. They are placed at equal intervals around the circle. The five intermediate hues are yellow-red, green-yellow, blue-green, purple-blue, and red-purple. Each of the 10 major hues are broken into 4 equal segments which are given the numerical prefixes 2.5, 5, 7.5 and 10. The initials of each hue are used as symbols to designate the ten hue sectors: R, YR, Y, GY, G, BG, B, PB, P and RP. The hue circle is arbitrarily divided into 100 steps or increments, with the zero point at the beginning of the red sector.

Value indicates the degree of lightness of a color in terms of a neutral gray scale. The scale ranges from 0 for black and 10 for white.

Chroma, on the other hand, is the degree of departure of a color from the neutral color scale of the same value. Chroma may be considered to measure the relative purity of a color. As a color gets more vivid, the chroma increases. Neutral colors are given a designation of 0 and there is no tangible upper limit. The scaling of chroma is visually uniform and the units are arbitrary. The chroma scale for normal color is from zero to 20. Fluorescent materials, however, have chromas as high as about 30.

The complete Munsell notation for a chromatic color is written "hue value/chroma". For instance, for a vivid red having a hue of 5 R, a value of 6 and a chroma of 8, the notation is 5 R 6/8.

Steps or increments on the Munsell color scale thus do not increase numerically by one. Instead, the steps or increments on the Munsell color scale may increase by less than 1 or greater than 1 and may include a letter designation when quantifying hue.

In order to complement colors between the bath tissue roll dispenser and the other paper dispensers, for instance, in one embodiment, a color appearing on the bath tissue dispenser may be within three steps or increments in terms of any one of hue, value or chroma of a color appearing on one or all of the remaining dispensers. For example, the color appearing on the tissue roll dispenser may be complemented with one or more colors appearing on the remaining dispensers so that at least two of the attributes or all three of the attributes of hue, value and chroma are within three steps, such as within two steps, or within one step of each other on the Munsell color scale.

In some embodiments, it may be desirable that one color appearing on the bath tissue roll dispenser does not identically match a color appearing on the remaining dispensers. For example, the color appearing on the bath roll dispenser may be at least one step, such as at least two steps away on the Munsell color scale from the color appearing on one of the other paper dispensers in terms of one or all of the attributes of hue, value and chroma.

In general, any color appearing on the bath tissue roll dispenser may be complemented with any color appearing on the remaining dispensers or products. For instance, the main or primary non-white color on the tissue roll dispenser may complement the main color on another dispenser or a secondary color on the tissue roll dispenser may complement a secondary color on one of the other dispensers. In still other embodiments, the main or primary color on the tissue roll dispenser may complement a secondary color on one of the other dispensers and vice versus.

Ultimately, through the use of complementing color and through the use of other coordinated design elements, the overall design appearing on the tissue roll dispenser may be coordinated with the overall design appearing on the other dispensers.

Figure 7:
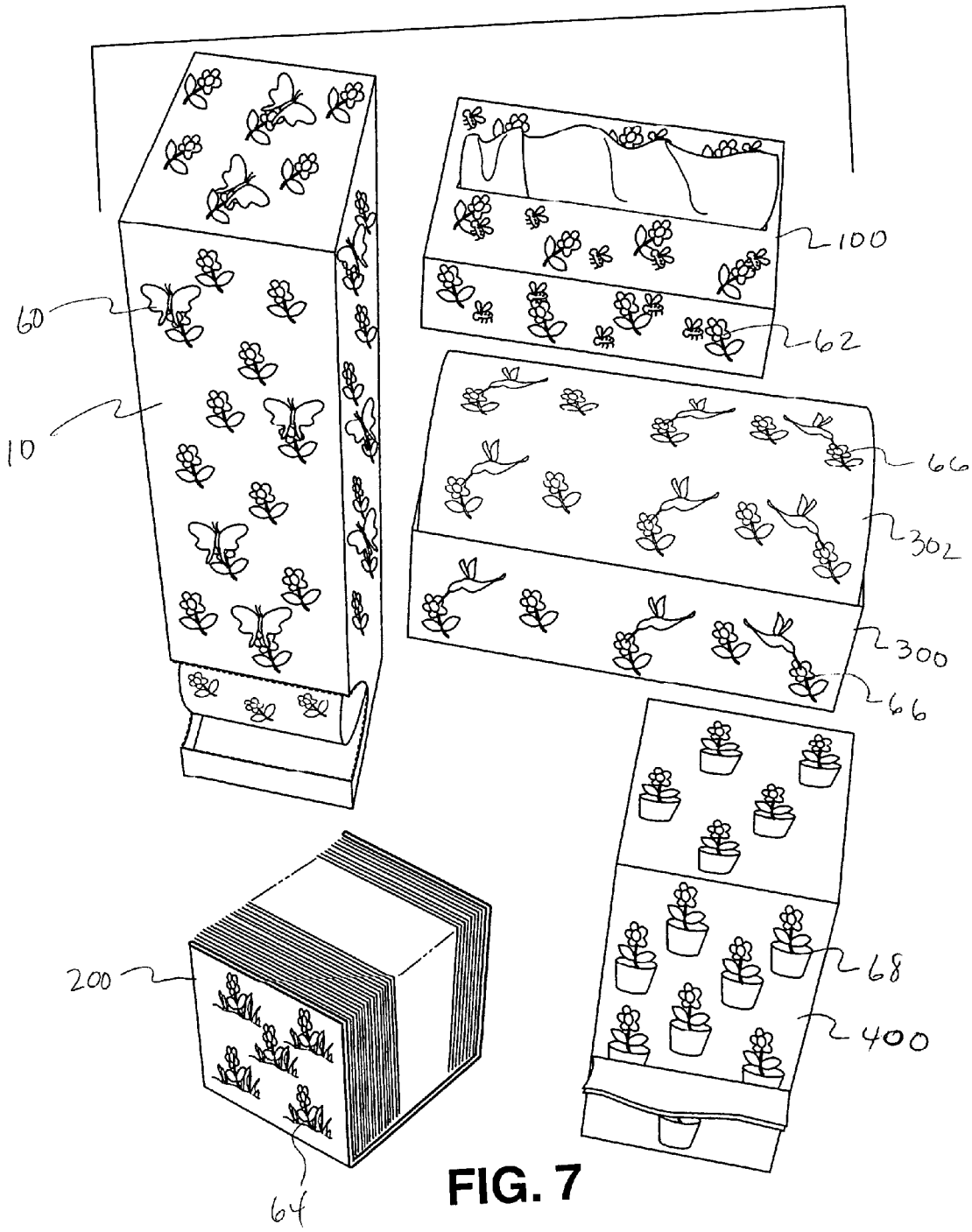
FIG. 7 is a perspective view of a coordinated series of disposable paper products made in accordance with the present invention.

As shown in FIG. 7, in one embodiment of the present invention, the design elements appearing on the paper or tissue dispensers predominate over the surface area of the dispenser. For instance, in order to maximize aesthetic appeal, less than one-sixth, such as less than one-tenth, of the surface area of each of the dispensers may include printed text, branding, and other labeling or regulatory information that does not fit with the intended design elements. For instance, printed text and branding may appear on the bottom of each dispenser or on the side of the dispenser that is not visible. It should be understood, however, that in some embodiments the branding itself may comprise the design element where the branding is presented in an aesthetic manner or pattern.

Since all of the paper dispensers including the bath tissue roll dispenser are made from disposable materials, various advantages and benefits are obtained with respect to the ability to maximize design and aesthetics. For instance, the design elements on the paper dispensers can change as the seasons change. For instance, in autumn, the dispensers may depict an autumn scene while in the spring they may depict a spring scene and so on. Further, during holidays, the dispensers can include design elements that correspond with the particular holiday that is approaching. For example, prior to Halloween, the dispensers can display traditional Halloween design elements, such as jack-o-lanterns, ghosts, goblins, bats and the like. These design elements can also appear on the paper products themselves as described above.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A bath tissue roll dispenser comprising:

at least two complete bath tissue rolls;

a container housing having a shape configured to hold the at least two bath tissue rolls in a vertical arrangement, the container housing including a first end and a second and opposite end, the container housing defining an opening located adjacent the first end for dispensing the bath tissue rolls therethrough, the container housing being disposable and being made from a paperboard material, the container housing having an interior surface and an exterior surface;

at least one design element appearing on the exterior surface of the container housing; and wherein the opening is covered by a film, the film defining a passage for removing the complete bath tissue rolls therethrough.

2. A bath tissue roll dispenser as defined in claim 1, wherein the dispenser contains at least three bath tissue rolls and wherein the container housing has a shape configured to hold the at least three bath tissue rolls in a vertical arrangement.

3. A bath tissue roll dispenser as defined in claim 1, wherein the dispenser contains at least four bath tissue rolls in two stacked columns, the container housing having a shape configured to hold the at least two stacked columns of the bath tissue rolls.

4. A bath tissue roll dispenser as defined in claim 1, wherein the container housing includes a flap that is defined by a perforation line, the perforation line being configured to be broken by a user in order to expose the opening for dispensing the bath tissue rolls.

5. A bath tissue roll dispenser as defined in claim 4, wherein the perforation line surrounds the flap such that the flap is completely removable from the container housing when the perforation line is broken by a user.

6. A bath tissue roll dispenser as defined in claim 4, wherein, after the perforation line is broken by a user, the flap remains connected to the container housing along a fold line, the flap pivoting along the fold line to expose the opening.

7. A bath tissue roll dispenser as defined in claim 1, wherein the paperboard material has a basis weight of less than about 450 gsm and a thickness of less than about 0.75 mm.

8. A bath tissue roll dispenser as defined in claim 1, wherein the design element comprises a graphic subject, a graphic style, or a pattern.

9. A bath tissue roll dispenser as defined in claim 1, wherein the design element appearing on the exterior surface of the container housing is coordinated with a design element appearing on the bath tissue rolls.

10. A bath tissue roll dispenser as defined in claim 1, wherein the exterior surface of the container housing defines a surface area and wherein the at least one design element covers at least ⅚ths of the surface area of the exterior surface.

11. A bath tissue roll dispenser as defined in claim 10, wherein any printed text and branding appearing on the container housing is present on less than ⅙th of the surface area of the exterior surface.

12. A tissue roll dispenser comprising:

at least two complete tissue rolls; and a container housing having a shape configured to hold the at least two tissue rolls in a vertical arrangement, the container housing including a first end and a second end, the container housing defining an opening located adjacent the first end, the opening being covered by a film, the film defining a passage for dispensing the complete tissue rolls therethrough.

13. A tissue roll dispenser as defined in claim 12, wherein the container housing includes a flap that is defined by a perforation line, the perforation line being configured to be broken by a user in order to expose the film for dispensing the tissue rolls.

14. A tissue roll dispenser as defined in claim 13, wherein the perforation line surrounds the flap such that the flap is completely removable from the container housing when the perforation line is broken by a user.

15. A tissue roll dispenser as defined in claim 13, wherein, after the perforation line is broken by a user, the flap remains connected to the container housing along a told line, the flap pivoting along the fold line to expose the opening.

16. A tissue roll dispenser as defined in claim 12, wherein the container housing is disposable and is made from a paperboard material, the paperboard material having a basis weight of less than about 300 gsm and a thickness of less than about 0.75 mm.

17. A tissue roll dispenser as defined in claim 12, wherein the container housing further comprises a connecting device which is configured to connect the container housing to a spindle.

18. A tissue roll dispenser as defined in claim 17, wherein the connecting device comprises a pair of opposing arms that are foldably positioned on the container housing and may be extended in order to connect to a spindle.

19. A tissue roll dispenser as defined in claim 12, wherein the container housing includes four rectangular sides that extend between the first end and the second and opposite end, the opening being located at least on one of the sides adjacent to the first end.

20. A tissue roll dispenser as defined in claim 12, wherein the container housing comprises a retaining member located below the opening for holding the tissue rolls within the housing.

21. A coordinated series of disposable paper products comprising:

a bath tissue dispenser for dispensing rolls of bath tissue, the bath tissue dispenser holding a plurality of complete rolls, the bath tissue dispenser being made from a disposable material comprising a paperboard material, the bath tissue dispenser displaying at least one design element on an exterior surface of the dispenser, the bath tissue dispenser defining an opening for dispensing the bath tissue rolls therethrough, the opening being covered by a flap or a film, the flap being pivotable for removing the complete bath tissue rolls therethrough, while the film defining a passage for removing the complete bath tissue rolls therethrough; and at least one other paper product dispenser, the paper product dispenser comprising a dispenser selected from the group consisting of a facial tissue dispenser, a paper towel dispenser, a moist wipe dispenser and a napkin holder, the at least one other paper product dispenser including at least one design element that coordinates with a design element on the bath tissue dispenser.

22. A coordinated series of disposable paper products as defined in claim 21, wherein the at least one design element on the bath tissue dispenser is coordinated with design elements on a facial tissue dispenser and a paper towel dispenser.

23. A coordinated series of disposable paper products as defined in claim 21, wherein the design element on the bath tissue dispenser comprises a texture, a graphic subject, a graphic style, or a pattern.

24. A coordinated series of disposable paper products as defined in claim 21, wherein the design element on the bath tissue dispenser and the design element on the at least one other paper product dispenser comprise complementary colors, and wherein the color on the bath tissue dispenser is within three steps on the Munsell color scale of a color appearing on the at least one other paper product dispenser in terms of any one of hue, value or chroma.

25. A coordinated series of disposable paper products as defined in claim 21, wherein the design element on the bath tissue dispenser and the design element on the at least one other paper product dispenser comprise complementary colors, and wherein the color on the bath tissue dispenser is within three steps on the Munsell color scale of a color appearing on the at least one other paper product dispenser for at least two of the three Munsell color qualities of hue, value or chroma.

26. A coordinated series of disposable paper products as defined in claim 21, wherein the design element on the bath tissue dispenser comprises a graphic style, the graphic style comprising photograph, pointillism, watercolor, or pencil drawings.

27. A coordinated series of disposable paper products as defined in claim 21, wherein at least two design elements appearing on the exterior surface of the bath tissue dispenser are coordinated with at least two design elements appearing on the at least one other paper product dispenser.

28. A coordinated series of disposable paper products as defined in claim 21, wherein at least two design elements appearing on the exterior surface of the bath tissue dispenser are coordinated with at least three design elements appearing on the at least one other paper product dispenser.

29. A coordinated series of disposable paper products as defined in claim 21, wherein an overall design of the design elements appearing on the bath tissue dispenser coordinates with an overall design of the design elements appearing on the at least one other paper product dispenser.

30. A coordinated series of disposable paper products as defined in claim 21, wherein the bath tissue dispenser comprises:

at least two bath tissue rolls; and a container housing having a shape configured to hold the at least two bath tissue rolls in a vertical arrangement, the container housing including a first end and a second and opposite end, the opening being located adjacent the first end for dispensing the bath tissues therethrough.

31. A coordinated series of disposable paper products as defined in claim 30, wherein the bath tissue dispenser includes the film located over the opening, the passage comprising a slit for dispensing the complete rolls of bath tissue therethrough.

32. A coordinated series of disposable paper products as defined in claim 21, wherein the at least one design element on the bath tissue dispenser is coordinated with design elements on a facial tissue dispenser and a moist wipe dispenser.

33. A coordinated series of disposable paper products as defined in claim 21, wherein the at least one design element on the bath tissue dispenser is coordinated with design elements on a moist wipe dispenser, the moist wipe dispenser containing moist bathroom tissues.

34. A coordinated series of disposable paper products as defined in claim 21, wherein the at least one design element does not include branding.

35. A coordinated series of disposable paper products as defined in claim 21, wherein the bath tissue dispenser includes both a flap and a film, the film being located in between the opening and the flap.

* * * * *